US006579939B2

(12) United States Patent
Ichikawa et al.

(10) Patent No.: US 6,579,939 B2
(45) Date of Patent: Jun. 17, 2003

(54) GOLF BALL

(75) Inventors: Yasushi Ichikawa, Chichibu (JP); Rinya Takesue, Chichibu (JP); Eiji Takehana, Chichibu (JP); Yoko Furuta, Nagoya (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 59 days.

(21) Appl. No.: 09/775,623

(22) Filed: Feb. 5, 2001

(65) Prior Publication Data

US 2001/0018374 A1 Aug. 30, 2001

(30) Foreign Application Priority Data

Feb. 3, 2000 (JP) ..... 2000-026516
Jun. 1, 2000 (JP) ..... 2000-164217

(51) Int. Cl.[7] ..... A63B 37/00; C08L 67/02

(52) U.S. Cl. ..... 525/89; 525/90; 525/92 A; 473/372; 473/373; 473/374; 473/378; 473/385

(58) Field of Search ..... 525/89, 90, 92 A; 473/372, 373, 374, 378, 385

(56) References Cited

U.S. PATENT DOCUMENTS

| | | | | |
|---|---|---|---|---|
| 4,337,947 A | | 7/1982 | Saito et al. | 273/235 |
| 4,919,434 A | | 4/1990 | Saito | 273/235 |
| 5,556,098 A | | 9/1996 | Higuchi et al. | 473/373 |
| 5,965,669 A | * | 10/1999 | Cavallaro et al. | |
| 5,994,470 A | * | 11/1999 | Tanaka et al. | |

FOREIGN PATENT DOCUMENTS

| | | |
|---|---|---|
| JP | 56-83367 | 7/1981 |
| JP | 62-275480 | 11/1987 |
| JP | 7-24084 | 1/1995 |
| JP | 9-176429 | 7/1997 |
| JP | 10-147690 | 6/1998 |
| JP | 11-342229 | 12/1999 |
| WO | 92/12206 | 7/1992 |

OTHER PUBLICATIONS

Machine Translation of J10147690, Jun. 1998.*
Abstract JP 10147690 A.
Abstract JP 9176429.
Abstract JP 11342229 A.
Abstract WO92/12206 Jul. 23, 1992.

* cited by examiner

*Primary Examiner*—David J. Buttner
(74) *Attorney, Agent, or Firm*—Sughrue Mion, PLLC

(57) ABSTRACT

A golf ball is formed with a resin composition which contains 5 to 95 weight % of a polyester block copolymer (A) and 95 to 5 weight % of an ionomer resin (B); and a (polyester-aromatic vinyl based copolymer) block copolymer (C), which is mixed with both the polyester block copolymer (A) and the ionomer resin (B) in an amount of 1 to 40 parts by weight on the basis of 100 parts by weight of the total of the polyester block copolymer (A) and the ionomer resin (B). The polyester block copolymer (A) mainly contains a high-melting point crystalline polymer segment (a1) composed of a crystalline aromatic polyester unit, and a low-melting point polymer segment (a2) composed of an aliphatic polyether unit and/or an aliphatic polyester unit. The ionomer resin (B) is produced by neutralizing a copolymer mainly containing an α-olefine (b1) and an α,β-unsaturated carboxylic acid (b2) having 3 to 8 carbon atoms with at least one metal ion (b3) selected from univalent, divalent, and trivalent metal ions. The (polyester-aromatic vinyl based copolymer) block copolymer (C) contains a block (c1) composed of a polyester, and at least one block (c2) selected from block or random copolymers containing aromatic vinyl based monomers and conjugated dienes and/or hydrogenated products thereof.

13 Claims, No Drawings

GOLF BALL

BACKGROUND OF THE INVENTION

The present invention relates to a golf ball which is capable of increasing the flying distance of the ball, improving the ball hitting feeling, and enhancing the durability of the ball.

A polyester block copolymer containing a crystalline aromatic polyester unit such as polybutylene terephthalate, as a hard segment and an aliphatic polyether unit such as poly(alkylene oxide) glycol and/or an aliphatic polyester unit such as polylactone, as a soft segment, is excellent in mechanical properties such as strength, impact resistance, elastic recovery, and flexibility and also excellent in low temperature/high temperature characteristics, and is good in thermoplasticity to be thereby easily moldable. Such a polyester block copolymer has become a focus of attention as a resin for a golf ball, for example, as disclosed in Japanese Patent Laid-open No. Hei 7-24084.

The above-described polyester block copolymer having excellent physical properties, however, is disadvantageous in that as the hardness thereof becomes higher, the mechanical properties such as impact resilience, strength, and impact resistance, and the low temperature characteristics become lower, and therefore, to increase the flying distance of a golf ball formed by using the polyester block copolymer, it has been required to further improve the physical properties of the polyester block copolymer.

On the other hand, an ionomer resin produced by neutralizing a copolymer containing α-olefine and α,β-unsaturated carboxylic acid with univalent, divalent, or trivalent metal ions is thermoplastic and thereby easily moldable, and further significantly tough to be thereby less broken even if being largely deformed by a high speed impact. The high toughness of the ionomer resin is advantageous in improving the abrasion resistance of a golf ball formed by using the ionomer resin and in enhancing the durability of the golf ball against repeated hitting thereof. In actual, the ionomer resin having the above excellent properties has been used as a cover material for golf balls over the years.

The ionomer resin, however, is insufficient in flexibility, and gives a rigid feeling to a player upon hitting a golf ball using the ionomer resin as a cover material.

To cope with such an inconvenience, there has been proposed a softened ionomer resin suitable as a resin composition for a golf ball, wherein the ionomer resin is provided by neutralizing a copolymer containing α-olefine, α,β-unsaturated carboxylic acid, and α,β-unsaturated carboxylate with univalent, divalent, or trivalent metal ions.

The softened ionomer resin, however, is poor in impact resilience and low temperature characteristic, and is therefore required to be further improved.

An attempt has been made to produce a golf ball using a resin composition obtained by mixing a polyester block copolymer with an ionomer resin for compensating the disadvantages of the polyester block copolymer and the ionomer resin with each other. These golf balls, each using a resin composition obtained by mixing a polyester block copolymer and an ionomer resin, has been proposed, for example, in Japanese Patent Laid-open Nos. Sho 56-83367 and Sho 62-275480. According to such a resin composition, since the polyester block copolymer excellent in flexibility and impact resilience is mixed with the ionomer resin poor in flexibility but excellent in toughness and impact resilience, it is possible to make effective use of the excellent performances of both the polyester block copolymer and the ionomer resin, and particularly to improve the impact resilience.

The above-described golf ball material, that is, the mixture of the polyester block copolymer and the ionomer resin, however, has a problem. Namely, since the polyester block copolymer and the ionomer resin are not excellent in compatibility so much, the golf ball material has an uneven morphology, with a result that the resin material is easy to orient upon injection molding thereof, tending to cause laminar peeling and also failing to obtain a sufficient durability of a golf ball formed by using the resin material against repeated hitting of the golf ball.

An attempt has been made to further improve the above-described resin composition. For example, a golf ball core material composed of a resin composition containing a polyester block copolymer, an ionomer resin, and an epoxy-containing compound has been proposed in WO92/12206, and a golf ball using a resin composition containing a polyester block copolymer, an ionomer resin, and an epoxidated diene based block copolymer has been proposed in Japanese Patent Laid-open No. Hei 9-176429.

Each of the resin compositions disclosed in the above-described documents is satisfactory to improve the laminar peeling by enhancing the compatibility of the polyester block copolymer with the ionomer resin, and therefore, becomes a resin composition excellent in flexibility and impact resilience suitable for a golf ball; however, such a resin composition has another problem that since it contains the epoxy-containing copolymer, the melt viscosity of the resin composition becomes higher, with a result that the resin composition is suitable for both extrusion molding and blow molding but unsuitable for injection molding generally used for molding a golf ball.

A thermoplastic polymer composition containing a polyester based resin, an addition polymerization based block copolymer, a polyester based block copolymer, and an ionomer resin, which is usable as a golf ball cover material, has been disclosed in Japanese Patent Laid-open No. Hei 10-147690.

The above-described thermoplastic polymer composition is a hard material being high in tensile strength and bending strength but is very high in stiffness modulus, and therefore, is different from a material having a high flexibility and a high impact resilience, such as rubber. Further, the thermoplastic polymer composition cannot exhibit a sufficient durability of a golf ball formed by using the resin composition against repeated hitting of the ball, which durability is required for a golf ball cover material. Accordingly, the thermoplastic polymer composition is unsuitable as the golf ball material.

A thermoplastic resin composition for a golf ball containing an ionomer resin, a polyester based thermoplastic elastomer, and a styrene based block copolymer has been disclosed in Japanese Patent Laid-open No. Hei 11-342229.

Such a thermoplastic resin composition for a golf ball is excellent in flexibility and elastic recovery; however, it is also insufficient in durability of a golf ball formed by using the thermoplastic resin composition against repeated hitting of the ball, which durability is required for a golf ball cover material.

As described above, at present, there does not exist a resin composition for a golf ball, which has a high flexibility and a high impact resilience, and also has a high toughness, particularly, a high flexural fatigue resistance and a high tear resistance, and which is good in melt flowability and thereby suitable for injection molding with less laminar peeling after molding.

SUMMARY OF THE INVENTION

An object of the present invention is to provide a golf ball which is capable of increasing the flying distance of the ball, improving the ball hitting feeling, and enhancing the durability of the ball.

To achieve the above object, the present inventors have made studies to develop a new thermoplastic resin composition for a golf ball, which is high in rupture strength and impact strength, has properties similar to those of rubber, such as a suitable flexibility and a high impact resilience, and is excellent in durability, particularly, flexural fatigue resistance and tear strength, and which is good in melt flowability and thereby suitable for injection molding with less laminar peeling after molding, by compensating the disadvantages of a polyester block copolymer and an ionomer resin used for a prior art resin composition for a golf ball with each other, and eventually found that a resin composition containing a polyester block copolymer (A), an ionomer resin (B), and a (polyester-aromatic vinyl based copolymer) block copolymer (C) at a specific mixing ratio has a high flexibility and a high impact resilience, and also has a high toughness, particularly, high flexural fatigue resistance and a high tear resistance, and is good in melt flowability and thereby suitable for injection molding with less laminar peeling after molding, wherein the polyester block copolymer (A) mainly contains a high-melting point crystalline polymer segment (a1) composed of a crystalline aromatic polyester unit, and a low-melting point polymer segment (a2) composed of an aliphatic polyether unit and/or an aliphatic polyester unit; the ionomer resin (B) is produced by neutralizing a copolymer mainly containing an α-olefine (b1) and an α,β-unsaturated carboxylic acid (b2) having 3 to 8 carbon atoms with at least one metal ions (b3) selected from univalent, divalent, and trivalent metal ions; and the (polyester-aromatic vinyl based copolymer) block copolymer (C) contains a block (c1) composed of a polyester, and at least one block (c2) selected from block or random copolymers containing aromatic vinyl based monomers and conjugated dienes and/or hydrogenated products thereof.

The present inventors have further examined the above-described resin composition, and found that a golf ball formed by using the resin composition is capable of increasing the flying distance of the ball, improving the ball hitting feeling, and enhancing the durability of the ball.

Accordingly, the present invention provides a golf ball in which a solid core or center, an intermediate layer or a cover layer is formed with a resin composition comprising:

5 to 95 weight % of a polyester block copolymer (A) and 95 to 5 weight % of an ionomer resin (B); and a (polyester-aromatic vinyl based copolymer) block copolymer (C), which is mixed with both the polyester block copolymer (A) and the ionomer resin (B) in an amount of 1 to 40 parts by weight on the basis of 100 parts by weight of the total of the polyester block copolymer (A) and the ionomer resin (B);

wherein the polyester block copolymer (A) mainly contains a high-melting point crystalline polymer segment (a1) composed of a crystalline aromatic polyester unit, and a low-melting point polymer segment (a2) composed of an aliphatic polyether unit and/or an aliphatic polyester unit;

the ionomer resin (B) is obtained by neutralizing a copolymer mainly containing an α-olefine (b1) and an α,β-unsaturated carboxylic acid (b2) having 3 to 8 carbon atoms with at least one metal ion (b3) selected from univalent, divalent, and trivalent metal ions; and the (polyester-aromatic vinyl based copolymer) block copolymer (C) contains a block (c1) composed of a polyester, and at least one block (c2) selected from block or random copolymers containing aromatic vinyl based monomers and conjugated dienes and/or hydrogenated products thereof.

The resin composition used for forming a golf ball of the present invention has a high flexibility and a high impact resilience, and also has a high toughness, particularly, a high flexural fatigue resistance and a high tear resistance, and is good in melt flowability and thereby suitable for injection molding with less laminar peeling after molding, and a golf ball of the present invention, which can be easily obtained by using the resin composition of the present invention, has a good balance between the carrying distance, feeling against ball hitting, and durability.

DETAILED DESCRIPTION OF THE PREFERRED EMBODIMENTS

A resin composition used for forming a golf ball of the present invention contains a polyester block copolymer as an essential component (A). The component (A) mainly contains a high-melting point crystalline polymer segment (a1) composed of a crystalline aromatic polyester unit, and a low-melting point polymer segment (a2) composed of an aliphatic polyether unit and/or an aliphatic polyester unit.

The component (a1) is preferably polybutylene terephthalate prepared from terephthalic acid and/or dimethylterephthalate and 1,4-butanediol. Alternatively, the component (a1) may be a polyester prepared from a dicarboxylic acid component and a diol component having a molecular weight of 300 or less, or a copolymerized polyester prepared from two kinds or more of these dicarboxylic acid components and the diol components, wherein the dicarboxylic acid component may be selected from isophthalic acid, phthalic acid, naphthalene-2,6-dicarboxylic acid, naphthalene-2,7-dicarboxylic acid, diphenyl-4,4'-dicarboxylic acid, diphenoxyethanedicarboxylic acid, 5-sulfoisophthalic acid, or an ester forming derivative thereof; and the diol component may be selected from an aliphatic diol such as ethyleneglycol, trimethyleneglycol, pentamethyleneglycol, hexamethyleneglycol, neopentylglycol, or decamethyleneglycol, an alicyclic diol such as 1,4-cyclohexanedimethanol or tricyclodecanedimethylol, and an aromatic diol such as xyleneglycol, bis(p-hydroxy)diphenyl, bis(p-hydroxyphenyl)propane, 2,2-bis[4-(2-hydroxyethoxy)phenyl]propane, bis[4-(2-hydroxy)phenyl]sulfone, 1,1-bis[4-(2-hydroxyethoxy)phenyl]cyclohexane, 4-4'-dihydroxy-p-terphenyl, or 4-4'-dihydroxy-p-quarter-phenyl. Further, a polyfunctional carboxylic acid component having three or more functional groups, a polyfunctional oxyacid, and a polyfunctional hydroxy component can be copolymerized in a range of 5 mol % or less.

The component (a2) is a low-melting point polymer segment (a2) composed of an aliphatic polyether unit and/or an aliphatic polyester unit. Specific examples of the aliphatic polyether units may include poly(ethylene oxide) glycol, poly(propylene oxide) glycol, poly(tetramethylene oxide) glycol, poly(hexamethylene oxide)glycol, ethylene oxide-propylene oxide copolymer, ethylene oxide addition polymer of poly(propylene oxide)glycol, and ethylene oxide-tetrahydrofuran copolymer.

Specific examples of the aliphatic polyester units may include poly(ε-caprolactone), polyenanthalactone, polycaprolactone, polybutylene adipate, and polyethylene adipate.

From the viewpoint of the elastic characteristic of the polyester block copolymer (A), the component (a2) may be selected from poly(tetramethylene oxide)glycol, ethylene oxide addition polymer of poly(propylene oxide)glycol, poly(ε-caprolactone), polybutylene adipate, and polyethylene adipate. In particular, poly(tetramethylene oxide)glycol is preferably used as the component (a2).

The number-average molecular weight of the low-melting point polymer segment is preferably in a range of about 300 to about 6000 in a copolymerized state.

According to the present invention, the copolymerized amount of the component (a2) contained in the component (A) is preferably adjusted to be in a range of 15 to 90 weight %, preferably 50 to 90 weight %. If the copolymerized amount of the component (a2) is more than 90 weight %, the component (a2) cannot exhibit, when mixed with the component (a1) into the thermoplastic copolymer (A), a sufficient melt characteristic, and therefore, cannot be uniformly mixed with the component (a1). If it is less than 15 weight %, the copolymer (A) obtained by mixing the component (a2) with the component (a1) is poor in flexibility and impact resilience.

The component (A) mainly containing the component (a1) and the component (a2) can be produced by any one of known production processes, some of which are shown as follows:

(1) a process of subjecting diester of dicarboxylic acid and lower alcohol, glycol having a low molecular weight in an excess amount, and a low-melting point polymer segment to ester interchange reaction under catalyst, and polycondensating a reaction product thus obtained;

(2) a process of subjecting dicarboxylic acid, glycol in an excess amount, and a low-melting point polymer segment to esterification under catalyst, and polycondensating a reaction product thus obtained;

(3) a process of previously preparing a high-melting point crystalline polymer segment, adding a low-melting point polymer segment thereto, and randomizing both the segments by ester interchange reaction;

(4) a process of linking a high-melting point crystalline polymer segment to a low-melting point polymer segment with a chain-linking agent; and (5) a process of making, in the case of using poly(ε-caprolactone) as a low-melting point polymer segment, ε-caprolactone monomers addition-react with a high-melting point crystalline polymer segment.

The polyester block copolymer as the component (A) may have a Shore D hardness, measured in accordance with ASTM D-2240, in a range of 10 or more, preferably 25 or more, and 55 or less, preferably 50 or less. It may be preferred that the polyester block copolymer as the component (A) be softer than an ionomer resin as a component (B) to be described later.

The component (A) may have a high impact resilience, measured in accordance with BS 903, in a range of 40% or more, preferably 50% or more, and 90% or less. If the impact resilience of the component (A) is less than 40%, the impact resilience of the resin composition obtained by mixing the components (A), (B) and (C) with each other becomes smaller, with a result that the carrying performance of a golf ball formed by using the resin composition may be degraded.

The component (A) may have a relatively low stiffness modulus, measured in accordance with JIS K-7106, in a range of 5 MPa or more, preferably 10 MPa or more, more preferably 15 MPa or more, and 250 MPa or less, preferably 200 MPa or less, more preferably 150 MPa or less. If the stiffness modulus of the component (A) is more than 250 MPa, the stiffness of the resin composition obtained by mixing the components (A), (B) and (C) with each other becomes higher, with a result that the feeling of hitting a golf ball formed by using the resin composition and the durability thereof may be degraded.

The resin composition used for forming a golf ball of the present invention contains an ionomer resin as an essential component (B). The ionomer resin as the component (B) is produced by neutralizing a copolymer mainly containing an α-olefine (b1) and an α,β-unsaturated carboxylic acid (b2) having 3 to 8 carbon atoms with at least one kind of metal ions (b3) selected from univalent, divalent, and trivalent metal ions.

Specific examples of the α-olefines as the components (b1) may include ethylene, propylene, and butene-1. In particular, ethylene is preferably used as the component (b1).

Specific examples of the α, β-unsaturated carboxylic acids having 3 to 8 carbon atoms as the components (b2) may include acrylic acid, methacrylic acid, ethacrylic acid, itaconic acid, and maleic acid. In particular, acrylic acid or methacrylic acid is preferably used as the component (b2).

The copolymer of the component (B), which mainly contains the component (b1) and the component (b2), may further contain an acrylate and/or a methacrylate as an optional component (b4).

Specific examples of the acrylates or methacrylates as the components (b4) may include methyl acrylate, ethyl acrylate, isobutyl acrylate, acrylic acid-n-butyl, acrylic acid-2-ethylhexyl, methyl methacrylate, methacrylic acid-n-butyl, and isobutyl methacrylate. In particular, methyl acrylate, ethyl acrylate, or acrylic acid-n-butyl is preferably used as the component (b4).

The copolymer of the component (B) may contain the α,β-unsaturated carboxylic acid in an amount of 0.2 mol % or more, preferably 5 mol % or more, and 25 mol % or less, preferably 15 mol % or less, regardless of whether or not the copolymer contains the optional component (b4). If the content of the unsaturated carboxylic acid is less than 0.2 mol %, the stiffness and impact resilience of the copolymer become small, with a result that the carrying performance of a golf ball formed by using the resin composition obtained by mixing the components (A), (B) and (C) with each other.

The ionomer resin as the component (B) is obtained by neutralizing the above-described copolymer with at least one kind of metal ions (b3) selected from univalent, divalent, and trivalent metal ions. Specific examples of the univalent, divalent, and trivalent metal ions suitable for neutralization may include sodium ions, potassium ions, lithium ions, magnesium ions, calcium ions, zinc ions, aluminum ions, ferrous ions, and ferric ions.

The introduction of such metal ions can be performed by making the copolymer mainly containing the components (b1) and (b2) and the optional component (b4) react with a hydride, methoxide, ethoxide, carbonate, nitrate, formate, acetate, or oxide of the above-described univalent, divalent, or trivalent metal. In this neutralization, at least 10 mol % or more, preferably 30 mol % or more, and 100 mol % or less, preferably 90 mol % or less of the carboxylic groups in the copolymer is preferably neutralized with the metal ions. If the neutralized amount is less than 10 mol %, the impact resilience of the ionomer resin may be degraded.

As the ionomer resin as the component (B), there may be used a commercial product. Specific examples of the commercial products may include Himilan® 1554, 1557, 1601, 1605, 1706, 1855, 1856, AM7315, AM7316, AM7317, and AM7318 (sold by Du Pont-Mitsui Polychemicals Co., Ltd.), and Surlyn® 6320, 7930, 8120, 8945, and 9945 (sold by Du Pont DE NEMOURS & COMPANY).

According to the present invention, a single ionomer resin obtained by neutralizing a copolymer with one kind of metal ions may be used as the component (B); however, two kinds or more ionomer resins obtained by neutralizing a copolymer with different kinds of metal ions are preferably used as the component (B). For example, in the case of using the above-described commercial products, it may be preferred to use two kinds or more ionomer resins of different ion types in combination. This is effective to enhance the balance between the melt flowability, flexural fatigue resistance, tear strength, and impact resilience, and hence to improve the properties of the resin composition for a golf ball.

The component (B) may have a Shore D hardness, measured in accordance with ASTM D-2240, in a range of 45 or more, preferably 55 or more, more preferably 60 or more, and 80 or less, preferably 75 or less, more preferably 70 or less. It may be preferred that the hardness of the component (B) be higher than that of the component (A).

The component (B) may have a stiffness modulus, measured in accordance with JIS K-7106, in a range of 25 MPa or more, preferably 50 MPa or more, more preferably 200 MPa or more, and 500 MPa or less, preferably 450 MPa or less, more preferably 400 MPa or less. It may be preferred that the stiffness modulus of the component (B) be higher than that of the component (A).

In the resin composition used for forming a golf ball of the present invention, from the viewpoint of enhancing the toughness, flexibility, and impact resilience of the resin composition, the content of the component (A) may be in a range of 5 to 95 weight %, preferably 10 to 90 weight %, more preferably 20 to 80 weight %, and the content of the component (B) may be in a range of 95 to 5 weight %, preferably 90 to 10 weight %, more preferably 80 to 20 weight %, on the basis of the total amount of the components (A) and (B). If either of the contents of the components (A) and (B) is out of the above-described range, there arises a problem in degrading the performances, such as the ball hitting feeling, durability, and carrying characteristic, of a golf ball formed by using the resin composition.

According to the present invention, in the case of mixing the component (A) with the component (B), from the viewpoint of enhancing the impact resilience, low temperature characteristics, and mechanical strength of the final resin composition, a polyester block copolymer being lower in stiffness modulus and surface hardness and higher in impact resilience may be selected as the component (A), and an ionomer resin being higher in stiffness modulus and surface hardness may be selected as the component (B).

In the case of mixing the component (A) with the component (B), to make effective use of the characteristics of both the components (A) and (B), a different in surface hardness measured in Shore D hardness between the components (A) and (B) [hardness of the component (B)–hardness of the component (A)] may be in a range of 10 or more, preferably 20 or more, more preferably 30 or more, and 50 or less.

Further, in the case of mixing the component (A) with the component (B), a difference in stiffness modulus between the components (A) and (B) [stiffness modulus of the component (B)–stiffness modulus of the component (A)] may be in a range of 100 MPa or more, preferably 150 MPa or more, more preferably 200 MPa or more. If the difference in stiffness modulus is less than 100 MPa, the improvement of the impact resilience of the final resin composition may become insufficient.

The resin composition used for forming a golf ball of the present invention contains a (polyester-aromatic vinyl based copolymer) block copolymer as an essential component (C). The component (C) contains a block (c1) composed of a polyester, and a block (c2) formed by a block or random copolymer containing aromatic vinyl based monomers and a conjugated diene and/or a hydrogenated product thereof.

Specific examples of the polyesters of the components (c1) may include polyethylene terephthalate, polybutylene terephthalate, polyethylene naphthalate, polybutylene naphthalate, poly-1,4-cyclohexanedimethylene terephthalate, polycaprolactone, and polybutylene adipate. Of these materials, an aromatic polyester, particularly, polybutylene terephthalate is preferably used as the polyester of the component (c1).

Specific examples of the aromatic vinyl based monomers of the components (c2) may include styrene, α-methylstyrene, vinyltoluene, p-methylstyrene, p-t-butylstyrene, o-ethylstyrene, o-dichlorostyrene, and p-diclorostyrene.

Specific examples of the conjugated dienes may include butadiene, isoprene, 2,3-dimethyl-1,3-butadiene, 1,3-pentadiene, 2-methyl-1,3-pentadiene, 1,3-hexadiene, 4,5-diethyl-1,3-octadiene, 3-butyl-1,3-octadiene, and chloroprene.

In particular, a block or random copolymer obtained from styrene, butadiene or isoprene and/or a hydrogenated product thereof is preferably used as the component (c2).

The (polyester-aromatic vinyl based copolymer) block copolymer as the component (C) is obtained by copolymerizing the block (c1) composed of a polyester, and the block (c2) formed by a block or random copolymer containing aromatic vinyl based monomers and a conjugated diene and/or a hydrogenated product thereof. In particular, from the viewpoint of enhancing the compatibility with both the components (A) and (B), the block copolymer as the component (C) may be a block copolymer obtained by copolymerizing a block composed of polybutylene terephthalate as the component (c1) and a block formed by a styrene-butadiene block or random copolymer or a styrene-isoprene block or random copolymer and/or a hydrogenated product thereof as the component (c2). The block copolymer may be of any kind selected from a diblock copolymer, a triblock copolymer, and a multiblock copolymer.

From the viewpoint of the resin strength accompanied by the compatibility, the content of the component (C) may be 1 part by weight or more, preferably 2 parts by weight or more, more preferably 3 parts by weight or more, and 40 parts by weight or less, preferably 30 parts by weight or less, more preferably 20 parts by weight or less on the basis of 100 parts by weight of the total of the polyester block copolymer (A) and the ionomer resin (B). If the content of the component (C) is out of the above range, the impact resilience of a golf ball formed by the resin composition may become insufficient and the durability of the golf ball be degraded.

The resin composition used for forming a golf ball of the present invention containing the components (A), (B) and (C) as the essential components may further contain various known additives within such ranges as not to depart from the object of the present invention. Specific examples of these additives may include a hindered phenol based, phosphite based, thioester based, or aromatic amine based oxidation inhibitor; a benzophenon based, benzotriazole based, or hindered amine based light-proof agent; a coloring agent such as pigment or dye; and other additives such as an antistatic agent, a conductive agent, a flame retardant, a stiffener, a filler, plasticizer, and a mold releasing agent.

The resin composition used for forming a golf ball of the present invention containing the components (A), (B), and (C) and various additives as needed can be produced, for example, in accordance with one of the following methods (1), (2), and (3):

The method (1) involves mixing the polyester block copolymer (A), the ionomer resin (B), and the (polyester-aromatic vinyl based copolymer) block copolymer (C) to prepare a raw material, supplying the raw material to a screw type extruder, and kneading the raw material in a molten state by the extruder.

The method (2) involves supplying the polyester block copolymer (A) to a screw type extruder and melting it, supplying the ionomer resin (B) and the (polyester-aromatic vinyl based copolymer) block copolymer (C) to the extruder through another supply port, and kneading them in a molten state by the extruder.

The method (3) involves supplying the ionomer resin (B) to a screw type extruder and melting it, supplying the polyester block copolymer (A) and the (polyester-aromatic vinyl based copolymer) block copolymer (C) to the extruder through another supply port, and kneading them in a molten state by the extruder.

Since the resin composition used for forming a golf ball of the present invention can be easily molded by injection molding, it is possible to easily obtain a golf ball having a high flexibility and a high impact resilience by injection molding the resin composition.

The resin composition used for forming a golf ball of the present invention may have a Shore D hardness, measured in accordance with ASTM D-2240, in a range of 25 or more, preferably 30 or more, and 70 or less, preferably 60 or less, and more preferably 50 or less. In particular, the resin composition can be suitably used as a material having a relatively low hardness.

The resin composition used for forming a golf ball of the present invention may have an impact resilience, measured in accordance with BS 903, in a range of 40% or more, preferably 50% or more, and 90% or less. If the impact resilience of the resin composition is less than 40%, a golf ball formed by using the resin composition may be degraded.

Next, a golf ball of the present invention will be described. The golf ball has at least one ball structural portion (for example, a core, an intermediate layer, or a cover) formed by using the above-described resin composition, and it exhibits a high toughness, a high flexural fatigue resistance, and a high tear strength, and also has a high durability against ball hitting because of no laminar peeling. Such a golf ball can be easily produced by molding the resin composition because the resin composition has a high melt-flowability enough to allow molding of the resin composition in the form of a thin film.

The golf ball of the present invention can be formed as a two-piece golf ball including a core and a cover, a multi-piece golf ball including a core covered with two or more layers, a one-piece golf ball, or a thread wound golf ball by using the resin composition as various golf ball materials such as a core material, an intermediate layer material, a cover material, a one-piece golf ball material, and a solid center material (for thread wound golf ball).

The ball structural portions of the golf ball formed by the resin composition will be described in detail below.

In the case of using the above-described resin composition for a golf ball as a core material, the diameter of the core (solid core or solid center) made from the material may be in a range of 25.00 mm or more, preferably 35.0 mm or more, and 39.95 mm or less, preferably 38.90 mm or less.

In this case, to adjust the size and weight of the core in accordance with a golf rule, an inactive filler may be used for adjusting the specific gravity of the core. Specific examples of the inactive fillers may include zinc oxide, barium sulfate, silica, calcium carbonate, and zinc carbonate. In particular, barium sulfate is preferably used as the inactive filler. The content of the inactive filler is dependent on the specific gravity of each of the core and a cover, the specification on the weight of the ball, and the like and thereby not particularly limited but may be in a range of 10 parts by weight or more, preferably 15 parts by weight or more, and 60 parts by weight or less, preferably 30 parts by weight or less, on the basis of 100 parts by weight of the resin composition of the present invention.

In the case of using the resin composition for a golf ball as an intermediate layer material, the gage of an intermediate layer made from the material may be in a range of 0.5 mm or more, preferably 1.0 mm or more, more preferably 1.4 mm or more, and 3.0 mm or less, preferably 2.5 mm or less, more preferably 1.9 mm or less. If the gage of the intermediate layer is more than 3.0 mm, the impact resilience of a golf ball may be degraded and thereby the carrying distance thereof be shortened, and if it is less than 0.5 mm, the durability of the golf ball may be degraded.

In the case of using the resin composition for a golf ball as a cover material, the thickness of a cover made from the material may be in a range of 0.5 mm or more, preferably 1.0 mm or more, more preferably 1.4 mm or more, and 3.0 mm or less, preferably 2.5 mm or less, more preferably 1.9 mm or less. If the thickness of the cover is more than 3.0 mm, the impact resilience of a golf ball may be degraded and thereby the carrying distance thereof be shortened, and if it is less than 0.5 mm, the durability of the golf ball may be degraded.

In the case of using the resin composition for a golf ball as a one-piece golf ball material, the diameter of a one-piece golf ball made from the material may be in a range of 42.60 mm or more, preferably 42.65 mm or more, and 42.75 mm or less, preferably 42.70 mm or less.

Each of the above-described ball structural portions of the golf ball can be produced by compression-molding or injection-molding the resin composition for a golf ball in a mold. In particular, the injection molding process can be preferably used.

The golf ball of the present invention can be formed with its size and weight specified under the golf rules. In general, the diameter of the golf ball of the present invention may be in a range of 42.65 to 42.75 mm, and the weight of the golf ball of the present invention may be in a range of 45.0 to 45.5 g.

As described above, according to the golf ball of the present invention, at least one ball structural portion is formed by using the resin composition used for forming a golf ball of the present invention. In particular, to make effective use of the characteristic of the resin composition, an intermediate layer between a solid core and a cover of a solid golf ball may be made from the resin composition.

To obtain the above solid golf ball, there is no limitation in materials of structural portions other than the intermediate layer. For example, the core may be made from the resin composition of the present invention; however, it can be made from a general rubber based material. In the case of using the general rubber based material, the composition of the material and the vulcanization condition may be suitably adjusted. To be more specific, the rubber based material contains a base rubber, a crosslinking agent, a co-crosslinking agent, and an inactive filler. As the base rubber, natural rubber and/or synthetic rubber, which have been adopted for solid golf balls, may be used; however, according to the present invention, 1,4-polybutadiene having at least 40% of a cis-structure is preferably used. In this case, a suitable amount of natural rubber, polyisoprene rubber, and/or styrene-butadiene rubber may be added to the above 1,4-polybutadiene as needed.

As the crosslinking agent, there may be used an organic peroxide such as dicumyl peroxide or di-t-butyl peroxide. In particular, dicumyl peroxide is preferably used. The content of the crosslinking agent may be in a range of 0.5 part by weight or more, preferably 0.8 part by weight or more, and 3 parts by weight or less, preferably 1.5 parts by weight or less, on the basis of 100 parts by weight of the base rubber.

The co-crosslinking agent is not particularly limited but may be a metal salt of an unsaturated fatty acid, particularly, a zinc salt, a magnesium salt, or a calcium salt of an unsaturated fatty acid having 3 to 8 carbon atoms (for example, acrylic acid or methacrylic acid). In particular, a zinc salt of an unsaturated fatty acid, such as zinc acrylate or zinc methacrylate is preferably used. The content of the co-crosslinking agent may be in a range of 24 parts by weight or more, preferably 28 parts by weight or more, and 38 parts by weight or less, preferably 34 parts by weight or less, on the basis of 100 parts by weight of the base rubber.

As the inactive filler, there may be used zinc oxide, barium sulfate, silica, calcium carbonate, or zinc carbonate. In particular, zinc oxide is preferably used as the inactive filler. The content of the inactive filler is dependent on the specific gravity of each of a core and a cover, and the specification on weight of a ball, and the like and thereby not particularly limited, but may be in a range of 10 to 60 parts by weight on the basis of 100 parts by weight of the base rubber.

The composition for a core, containing the above-described components, is kneaded by using a general kneader, for example, a Banbury mixer/kneader/roll mill and is compression-molded or injection-molded by using a mold for a core; and a molded body is heated and hardened at a temperature being high sufficient to promote reaction of the crosslinking agent and co-crosslinking agent (for example, in a range of 130 to 170° C. in the case of using dicumyl peroxide as the crosslinking agent and zinc acrylate as the co-crosslinking agent).

The diameter of the solid core thus obtained is generally in a range of 38.85 to 39.95 mm.

An intermediate layer is then formed around the solid core by placing the solid core in a mold used for general ball molding, compressing-molding or injection-molding the resin composition used for forming a golf ball of the present invention as the intermediate layer material in the mold.

A cover is then formed on the intermediate layer by injection-molding a cover material. As the cover material, there may be used a known ionomer resin. Specific examples of the known ionomer resins may include Himilan® 1554, 1557, 1601, 1605, 1706, 1855, 1856, AM7315, AM7316, AM7317, and AM7318 (sold by Du Pont-Mitsui Polychemicals Co., Ltd.), and Surlyn® 6320, 7930, 8120, 8945, and 9945 (sold by Du Pont DE NEMOURS & COMPANY).

After the intermediate layer is covered with the cover, the resultant ball is subjected to polishing for deburring, pretreatment, and painting in accordance with the same manner as that of a general golf ball production process.

EXAMPLES

The present invention will be more clearly understood by way of, while not limited thereto, the following inventive and comparative examples:

In the examples, the physical properties of each material and the physical properties of a golf ball were measured as follows:

Physical Properties of Each Material

Melting Point

Each material was heated in a nitrogen gas atmosphere at a temperature rising rate of 10° C./min and the maximum temperature of the material at the melting peak was measured by using a differential scanning calorimeter (trade name: DSC-910, sold by Du Pont DE NEMOURS & COMPANY).

Melt Flow Rate (MFR)

The MFR of each material was measured at a load of 2160 g in accordance with ASTM D-1238.

Surface Hardness

The surface hardness (Shore D hardness) of each material was measured in accordance with ASTM D-2240.

Stiffness Modulus

The stiffness modulus of each material was measured in accordance with JIS K-7106.

Impact Resilience

The impact resilience of each material was measured in accordance with BS 903.

Flexural Fatigue Resistance

A pellet of each material was dried at 80° C. for 5 hr and was pressed at 230° C., to prepare a test piece having a thickness of 2 mm and a width of 20 mm.

The test piece was subjected to 50,0000 cycles of flexion under the following test condition, and the flexural fatigue resistance of the test piece was determined by measuring a length of a crack occurred in the test piece.

Test Condition:

tester: de Mattia machine test temperature: 23° C.

distance between chucks: 25 mm←→5.6 mm flexion cycle: 300 times/min

In this test, a test piece having a crack whose length is shorter exhibits a higher durability against ball hitting.

Tear Strength

The tear strength of each material was measured in accordance with ASTM D-624. A test piece having a thickness of 2 mm was measured by using a type C die. In this test, a test piece having a larger tear strength exhibits a higher durability against ball hitting.

Physical Properties of Golf Ball

Outside Diameter

The outside diameter (mm) of each of a core, a core covered with an intermediate layer, and a final product was measured for each golf ball.

Weight

The weight (g) of each of a core, a core covered with an intermediate layer, and a final product was measured for each golf ball.

Deformation

The deformation (mm) under a load of 100 kg of each of a core, a core covered with an intermediate layer, and a final product was measured for each golf ball. A larger deformation indicates a lower hardness.

Flying Distance

Each golf ball was hit at a head speed of 35 m/s by a wood #1 club mounted on a swing robot sold by True Temper Sports Inc., and the carry and total flying distance (m) of the golf ball were measured.

Durability Against Repeated Hitting

Each golf ball was repeatedly hit at a specific point at a head speed of 40 m/s by a wood #1 club mounted on a swing robot sold by True Temper Sports Inc., and the durability against repeated hitting of the golf ball was determined by measuring the number of cracks. The number of cracks was indicated by an index with an average number of cracks occurred in Comparative example 3 taken as 100.

Production of Golf Ball Core

A composition for a core, containing a cis-1,4-polybutadiene rubber, zinc acrylate, zinc oxide, dicumyl peroxide, and other additives shown in Table 1, was vulcanized in a mold, to form a core having physical properties and a shape shown in Table 1.

TABLE 1

| | | Core | |
|---|---|---|---|
| | | 1 | 2 |
| Composition (parts by weight) | Cis-1,4-polybutadiene | 100 | 100 |
| | Zinc acrylate | 24.4 | 25 |
| | Dicumyl peroxide | 1.2 | 1.2 |
| | Anti-aging agent | 0.2 | 0.2 |
| | Barium sulfate | 25.4 | 18.8 |
| | Zinc oxide | 5 | 5 |
| | Zinc salt of pentachlorothiophenol | 0.2 | 0.2 |
| Vulcanizing Condition | Temperature (° C.) | 155 | 155 |
| | Time (min.) | 15 | 15 |
| Core | Outside diameter (mm) | 35.2 | 35.2 |
| | Weight (g) | 27.6 | 27.8 |
| | Hardness (mm) | 4.3 | 4.3 |

Production of Polyester Block Copolymer (A-1)

First, 234 parts by weight of terephthalic acid, 215 parts by weight of 1,4-butanediol, and 723 parts by weight of poly(tetramethylene oxide)glycol having a number-average molecular weight of about 2000 were put, together with 2 parts by weight of titanium tetrabutoxide, in a reaction vessel having a helical ribbon type stirring blade, and heated at a temperature of 190 to 225° C. for 3 hr for esterification with reaction water discharged out of the reaction system.

Then, 0.5 part by weight of Irganox® 1010 (hindered phenol based oxidation inhibitor sold by Ciba-Geigy Limited) was added to the reaction mixture and heated at 245° C., followed by reduction of a pressure in the reaction system to 27 Pa for 40 min, and the mixture was polymerized under the condition for 170 min. The resultant polymer was discharged in water in strands, and the strands were cut into pellets.

Production of Polyester Block Copolymer (A-2)

First, 406 parts by weight of dimethylterephthalate, 257 parts by weight of 1,4-butanediol, and 576 parts by weight of poly(tetramethylene oxide)glycol having a number-average molecular weight of about 1400 were put, together with 1.5 parts by weight of titanium tetrabutoxide and 3 parts by weight of trimellitic acid anhydride, in the reaction vessel having a helical ribbon type stirring blade, and heated at 210° C. for 150 min to discharge methanol of 95% of the theoretical methanol amount out of the reaction system.

Then, 0.75 part by weight of Irganox® 1010 was added to the reaction mixture and heated at 245° C., followed by reduction of a pressure in the reaction system to 27 Pa for 40 min, and the mixture was polymerized under the condition for 160 min.

The resultant polymer was discharged in water in strands, and the strands were cut into pellets.

The composition and physical properties of each of the polyester block copolymers (A-1) and (A-2) were shown in Table 2. In Table 2, "PTMG-2000" designates poly (tetramethylene oxide)glycol having a number-average molecular weight of 2000, and "PTMG-1400" designates poly(tetramethylene oxide)glycol having a number-average molecular weight of 1400.

TABLE 2

| | Low-melting Point Polymer Segment | | | Physical Properties of Polyester Block Copolymer | | | |
|---|---|---|---|---|---|---|---|
| Symbol | Kind | Copolymerized amount (weight %) | Melting point (° C.) | MFR (measurement temperature) (g/10 min.) | Stiffness modulus | Impact resilience | Surface hardness |
| A-1 | PTMG-2000 | 77 | 170 | 18 (220° C.) | 30 | 78 | 32 |
| A-2 | PTMG-1400 | 63 | 182 | 25 (220° C.) | 50 | 72 | 40 |

Ionomer Resin

Ionomer resins used in Examples and Comparative Examples are shown in Table 3.

TABLE 3

| | Ionomer Resins | | | | |
|---|---|---|---|---|---|
| Symbol | Kind | Ion type | MFR (measurement temperature) (g/10 min.) | Stiffness modulus (MPa) | Surface hardness |
| B-1 | Himilan ® 1605 | Na | 2.8 (190° C.) | 280 | 67 |
| B-2 | Himilan ® 1706 | Zn | 0.7 (190° C.) | 240 | 66 |

TABLE 3-continued

| | Ionomer Resins | | | | |
|---|---|---|---|---|---|
| Symbol | Kind | Ion type | MFR (measurement temperature) (g/10 min.) | Stiffness modulus (MPa) | Surface hardness |
| B-3 | Surlyn ® 8220 | Na | 1.0 (190° C.) | 390 | 74 |
| B-4 | Himilan ® AM7315 | Zn | 1.2 (190° C.) | 350 | 70 |
| B-5 | Surlyn ® 8120 | Na | 1.0 (190° C.) | 55 | 46 |

(Polyester-Aromatic Vinyl Based Copolymer) Block Copolymer (Polyester-aromatic vinyl based copolymer) block copolymers used in Examples are shown in Table 4.

TABLE 4

| Symbol | (Polyester-Aromatic Vinyl Based Copolymer) Block Copolymer |
|---|---|
| C-1 | Block copolymer of polybutylene terephthalate and hydrogenated styrene-butadiene block copolymer |
| C-2 | Block copolymer of polybutylene terephthalate and hydrogenated styrene-isoprene block copolymer |

Resin Composition for Intermediate Layer

Examples 1 to 10

One or more of the ionomer resins (B-1) to (B-5) and each of the (polyester-aromatic vinyl based copolymer) block copolymers (C-1) and (C-2) of the present invention were mixed with each of the polyester block copolymers (A-1) and (A-2) at a mixing ratio shown in Table 5 by a V-blender. The mixture was kneaded in a melting state at 240° C. by using a biaxial extruder having a three-screw type screw portion of 45 mm in diameter and then pelletized, to obtain a resin composition for an intermediate layer.

TABLE 5

| | Composition (parts by weight) | | | | | | | | |
|---|---|---|---|---|---|---|---|---|---|
| Resin Composition Intermediate | Polyester block copolymer (A) | | Ionomer resin (B) | | | | | (Polyester-aromatic vinyl based copolymer) block copolymer (C) | |
| Layer | A-1 | A-2 | B-1 | B-2 | B-3 | B-4 | B-5 | C-1 | C-2 |
| Examples | | | | | | | | | |
| 1 | 70 | | 30 | | | | | | 15 |
| 2 | 50 | | 50 | | | | | | 15 |
| 3 | 30 | | 70 | | | | | | 15 |
| 4 | 50 | | 25 | 25 | | | | | 5 |
| 5 | 50 | | 25 | 25 | | | | | 10 |
| 6 | | 70 | 30 | | | | | 10 | |
| 7 | 50 | | | | 25 | 25 | | | 15 |
| 8 | 50 | | | | | 35 | 15 | | 15 |
| 9 | 90 | | 5 | 5 | | | | | 5 |
| 10 | 10 | | 45 | 45 | | | | | 10 |

Each of the resin compositions for intermediate layers in Examples 1 to 10 was measured in terms of melt flow rate (MFR), surface hardness (Shore D hardness), stiffness modulus, impact resilience, flexural fatigue resistance, and tear strength. The results are shown in Table 6.

TABLE 6

| Physical Properties of Resin Composition for Intermediate Layer | MFR at 220° C. (g/10 min.) | Surface hardness | Stiffness modulus (MPa) | Impact resilience (%) | Flexural fatigue resistance Length of crack (mm) | Tear strength (kN/m) |
|---|---|---|---|---|---|---|
| Examples | | | | | | |
| 1 | 21 | 39 | 70 | 69 | 15 | 100 |
| 2 | 15 | 48 | 140 | 59 | 13 | 110 |
| 3 | 9 | 55 | 230 | 54 | 12 | 130 |
| 4 | 14 | 47 | 120 | 61 | 0 | 140 |
| 5 | 12 | 48 | 140 | 60 | 1 | 150 |
| 6 | 15 | 49 | 160 | 59 | 2 | 170 |
| 7 | 15 | 53 | 250 | 56 | 10 | 120 |
| 8 | 15 | 48 | 140 | 59 | 13 | 110 |
| 9 | 16 | 34 | 47 | 75 | 14 | 100 |
| 10 | 6 | 63 | 280 | 43 | 9 | 160 |

Resin Composition for Intermediate Layer

Comparative Examples 1 to 6, 15, and 16

In these comparative examples, the (polyester-aromatic vinyl based copolymer) block copolymer was not mixed with be more specific, one or more of the ionomer resins (B-1) to (B-5) were mixed with the polyester block copolymer (A-1) at a mixing ratio shown in Table 7. The mixture was kneaded in a melting state in the same manner as that in Examples 1 to 10 and then pelletized, to obtain a resin composition for an intermediate layer. Physical properties of each of the resin compositions for intermediate layers in Comparative Examples 1–6, 15 and 16 were evaluated in the same manner as that in Examples 1 to 10. The results are shown in Table 8.

Resin Composition for Intermediate Layer

Comparative Examples 7 to 9

In these comparative examples, another polyester resin (p-1) was used in place of the polyester block copolymer (A). To be more specific, the ionomer resin (B-1) and the (polyester-aromatic vinyl based copolymer) block copolymer (C-2) were mixed with polybutylene terephthalate (P-1) at a mixing ratio shown in Table 7. The mixture was kneaded in a melting state in the same manner as that in Examples 1 to 10 and then pelletized, to obtain a resin composition for an intermediate layer. Physical properties of each of the resin compositions for intermediate layers in Comparative Examples 7 to 9 were evaluated in the same manner as that in Examples 1 to 10. The results are shown in Table 8.

Resin Composition for Intermediate Layer

Comparative Examples 10 and 11

In these comparative examples, the polyester block copolymers (A-1) and (A-2) were used as the resin compositions for intermediate layers, respectively. To be more specific, each of the polyester block copolymers (A-1) and (A-2) was pelletized, to obtain a resin composition for an intermediate layer. Physical properties of each of the resin compositions for intermediate layers in Comparative Examples 10 and 11 were evaluated in the same manner as that in Examples 1 to 10. The results are shown in Table 8.

Resin Composition for Intermediate Layer

Comparative Examples 12 to 14

In these comparative examples, epoxy denaturated aromatic vinyl based polymers (S-1) and (S-2), and non-denaturated aromatic vinyl based polymer (S-3) were used in place of the (polyester-aromatic vinyl based copolymer) block copolymer (C). To be more specific, two of the ionomer resins (B-1) to (B-4) and each of the epoxy denaturated aromatic vinyl based polymers (S-1) and (S-2) and the non-denaturated aromatic vinyl based polymer (S-3) were mixed with the polyester block copolymer (A-1) at a mixing ratio shown in Table 7. The mixture was kneaded in a melting state in the same manner as that in Example 5 and then pelletized. The resin in the form of pellets was subjected to injection-molding like Inventive Example 5; however, in this case, since the melt-viscosity of the resin was excessively high, the resin could not be sufficiently injected in a mold. As a result, it was failed to obtain resin compositions for intermediate layers in Comparative Examples 12 to 14.

S-1: Epoxidated (styrene-butadiene-styrene) block copolymer

S-2: Epoxidated (hydrogenated styrene-butadiene-styrene) block copolymer

S-3: (hydrogenated styrene-isoprene-styrene) block copolymer

TABLE 7

| Resin Composition for Intermediate | Composition (parts by weight) | | | | | | | | | | | | |
|---|---|---|---|---|---|---|---|---|---|---|---|---|---|
| | Polyester block copolymer A | | Ionomer resin (B) | | | | | (Polyester aromatic vinyl based copolymer) block copolymer (C) | | Another aromatic vinyl based copolymer | | | Another polyester resin |
| Layer | A-1 | A-2 | B-1 | B-2 | B-3 | B-4 | B-5 | C-1 | C-2 | S-1 | S-2 | S-3 | P-1 |
| Comparative Examples | | | | | | | | | | | | | |
| 1 | 70 | | 30 | | | | | | | | | | |
| 2 | 50 | | 50 | | | | | | | | | | |
| 3 | 30 | | 70 | | | | | | | | | | |
| 4 | 50 | | 25 | 25 | | | | | | | | | |
| 5 | 50 | | | | 25 | 25 | | | | | | | |
| 6 | 50 | | | | | 35 | 15 | | | | | | |
| 7 | | | 30 | | | | | | 15 | | | | 70 |
| 8 | | | 50 | | | | | | 15 | | | | 50 |
| 9 | | | 70 | | | | | | 15 | | | | 30 |
| 10 | 100 | | | | | | | | | | | | |
| 11 | | 100 | | | | | | | | | | | |
| 12 | 50 | | | | 25 | 25 | | | | 10 | | | |
| 13 | 50 | | | | 25 | 25 | | | | | 10 | | |
| 14 | 50 | | 25 | 25 | | | | | | | | 10 | |
| 15 | 90 | | 5 | | 5 | | | | | | | | |
| 16 | 10 | | 45 | | 45 | | | | | | | | |

TABLE 8

| Physical Properties of Resin Composition for Intermediate Layer | MFR at 220° C. (g/10 min.) | MFR at 240° C. (g/10 min.) | Surface hardness | Stiffness modulus (MPa) | Impact resilience (%) | Flexural fatigue resistance Length of crack (mm) | Tear strength (kN/m) |
|---|---|---|---|---|---|---|---|
| Comparative Examples | | | | | | | |
| 1 | 23 | | 37 | 50 | 67 | fracture | 40 |
| 2 | 16 | | 46 | 135 | 57 | fracture | 40 |
| 3 | 10 | | 53 | 200 | 52 | fracture | 60 |
| 4 | 14 | | 45 | 115 | 57 | fracture | 60 |
| 5 | 12 | | 46 | 135 | 58 | fracture | 50 |
| 6 | 15 | | 47 | 120 | 61 | fracture | 70 |
| 7 | | 18 | 85 | — | 26 | fracture | 80 |
| 8 | | 9 | 78 | — | 31 | fracture | 70 |
| 9 | | 5 | 72 | — | 35 | fracture | 90 |
| 10 | 25 | | 32 | 30 | 78 | fracture | 70 |
| 11 | 36 | | 40 | 50 | 71 | fracture | 80 |

TABLE 8-continued

| Physical Properties of Resin Composition for Intermediate Layer | MFR at 220° C. (g/10 min.) | MFR at 240° C. (g/10 min.) | Surface hardness | Stiffness modulus (MPa) | Impact resilience (%) | Flexural fatigue resistance Length of crack (mm) | Tear strength (kN/m) |
|---|---|---|---|---|---|---|---|
| 12 | 0.5 | | 48 | 130 | 59 | — | — |
| 13 | 0.3 | | 47 | 120 | 58 | — | — |
| 14 | 16 | | 43 | 90 | 55 | fracture | 80 |
| 15 | 17 | | 33 | 45 | 72 | fracture | 60 |
| 16 | 7 | | 61 | 270 | 41 | fracture | 70 |

From the results shown in Table 6, it becomes apparent that each of the resin compositions for intermediate layers in Examples 1 to 10 has a high flexibility, a high impact resilience, a high flexural fatigue resistance, and a high tear strength. On the contrary, from the results shown in Table 8, it becomes apparent that each of the resin composition not containing the (polyester-aromatic vinyl based copolymer) block copolymer (C), the resin composition using the polyester resin different from the polyester block copolymer (A), and the polyester block copolymer is poor in flexural fatigue resistance and is low in tear strength.

Each of three-piece golf balls shown in Table 9 to 11 was produced by using each of the cores shown in Table 1, each of the resin compositions for intermediate layers shown in Tables 5 and 7, and a cover resin containing a mixed ionomer resin (Himilan 1706:Himilan 1605=1:1), titanium dioxide, and magnesium stearate at a mixing ratio of 96:3:1 and having a surface hardness (shore D hardness) of 67 and a stiffness modulus of 310 MPa.

Each of the golf balls thus obtained was evaluated in the same manner as that described above. The results are shown in Table 9 to 11.

TABLE 9

| | Examples | | | | | | | | | |
|---|---|---|---|---|---|---|---|---|---|---|
| | 1 | 2 | 3 | 4 | 5 | 6 | 7 | 8 | 9 | 10 |
| Core | | | | | | | | | | |
| Kind | 1 | 1 | 1 | 1 | 1 | 1 | 1 | 1 | 1 | 1 |
| Outside diameter (mm) | 35.2 | 35.2 | 35.2 | 35.2 | 35.2 | 35.2 | 35.2 | 35.2 | 35.2 | 35.2 |
| Weight (g) | 27.6 | 27.6 | 27.6 | 27.6 | 27.6 | 27.6 | 27.6 | 27.6 | 27.6 | 27.6 |
| Hardness (mm) | 4.3 | 4.3 | 4.3 | 4.3 | 4.3 | 4.3 | 4.3 | 4.3 | 4.3 | 4.3 |
| Intermediate layer Gage (mm) | 1.6 | 1.6 | 1.6 | 1.6 | 1.6 | 1.6 | 1.6 | 1.6 | 1.6 | 1.6 |
| Product | | | | | | | | | | |
| Outside diameter (mm) | 42.7 | 42.7 | 42.7 | 42.7 | 42.7 | 42.7 | 42.7 | 42.7 | 42.7 | 42.7 |
| Weight (g) | 45.2 | 45.1 | 45.1 | 45.1 | 45.1 | 45.2 | 45.1 | 45.1 | 45.3 | 45.0 |
| Hardness (mm) | 3.2 | 3.0 | 2.8 | 3.1 | 3.0 | 2.9 | 2.9 | 3.0 | 3.4 | 2.7 |
| Carrying performance HS35 | | | | | | | | | | |
| Carry (m) | 142.0 | 142.5 | 143.0 | 142.5 | 142.6 | 142.5 | 143.0 | 142.3 | 142.0 | 143.5 |
| Total (m) | 155.5 | 155.7 | 155.8 | 155.7 | 155.7 | 155.5 | 156.5 | 155.8 | 155.0 | 156.0 |
| Spin performance (rpm) | 3300 | 3460 | 3650 | 3420 | 3460 | 3520 | 3700 | 3470 | 3250 | 3700 |
| Durability against repeated ball hitting | 175 | 200 | 225 | 180 | 200 | 175 | 225 | 210 | 170 | 230 |
| Feeling | good | good | good | good | good | good | good | good | good | good |

TABLE 10

| | Comparative Examples | | | | | |
|---|---|---|---|---|---|---|
| | 1 | 2 | 3 | 4 | 5 | 6 |
| Core | | | | | | |
| Kind | 1 | 1 | 1 | 1 | 1 | 1 |
| Outside diameter (mm) | 35.2 | 35.2 | 35.2 | 35.2 | 35.2 | 35.2 |
| Weight (g) | 27.6 | 27.6 | 27.6 | 27.6 | 27.6 | 27.6 |
| Hardness (mm) | 4.3 | 4.3 | 4.3 | 4.3 | 4.3 | 4.3 |
| Intermediate layer Gage (mm) | 1.6 | 1.6 | 1.6 | 1.6 | 1.6 | 1.6 |
| Product | | | | | | |
| Outside diameter (mm) | 42.7 | 42.7 | 42.7 | 42.7 | 42.7 | 42.7 |
| Weight (g) | 45.2 | 45.1 | 45.1 | 45.1 | 45.1 | 45.1 |
| Hardness (mm) | 3.4 | 3.2 | 3.0 | 3.3 | 3.1 | 3.2 |
| Carrying performance HS35 | | | | | | |
| Carry (m) | 140.0 | 142.5 | 141.0 | 140.5 | 141.0 | 140.3 |
| Total (m) | 153.5 | 153.7 | 153.8 | 153.7 | 154.5 | 153.8 |

TABLE 10-continued

| | Comparative Examples | | | | | |
|---|---|---|---|---|---|---|
| | 1 | 2 | 3 | 4 | 5 | 6 |
| Spin performance (rpm) | 3350 | 3510 | 3710 | 3470 | 3750 | 3520 |
| Durability against repeated ball hitting | 55 | 80 | 100 | 60 | 100 | 90 |
| Feeling | good | good | good | good | good | good |

TABLE 11

| | Comparative Examples | | | | | | | | | |
|---|---|---|---|---|---|---|---|---|---|---|
| | 7 | 8 | 9 | 10 | 11 | 12 | 13 | 14 | 15 | 16 |
| Core | | | | | | | | | | |
| Kind | 2 | 2 | 2 | 2 | 2 | Not molded into ball because of high viscosity of resin | | 2 | 1 | 1 |
| Outside diameter (mm) | 35.2 | 35.2 | 35.2 | 35.2 | 35.2 | | | 35.2 | 35.2 | 35.2 |
| Weight (g) | 27.8 | 27.8 | 27.8 | 27.8 | 27.8 | | | 27.8 | 27.6 | 27.6 |
| Hardness (mm) | 4.3 | 4.3 | 4.3 | 4.3 | 4.3 | | | 4.3 | 4.3 | 4.3 |
| Intermediate layer Gage (mm) | 1.6 | 1.6 | 1.6 | 1.6 | 1.6 | | | 1.6 | 1.6 | 1.6 |
| Product | | | | | | | | | | |
| Outside diameter (mm) | 42.7 | 42.7 | 42.7 | 42.7 | 42.7 | | | 42.7 | 42.7 | 42.7 |
| Weight (g) | 45.3 | 45.1 | 45.0 | 45.1 | 45.1 | | | 45.1 | 45.3 | 45.0 |
| Hardness (mm) | 1.8 | 2.0 | 2.2 | 3.5 | 3.2 | | | 3.1 | 3.5 | 2.8 |
| Carrying performance HS35 | | | | | | | | | | |
| Carry (m) | 130.0 | 132.8 | 136.2 | 142.1 | 142.5 | | | 142.1 | 138.5 | 141.0 |
| Total (m) | 135.7 | 137.2 | 141.0 | 153.7 | 153.7 | | | 153.6 | 153.0 | 154.0 |
| Spin performance (rpm) | 3900 | 3850 | 3800 | 3200 | 3350 | | | 3340 | 3250 | 3700 |
| Durability against repeated ball hitting | 10 | 10 | 10 | 30 | 50 | | | 50 | 45 | 105 |
| Feeling | rigid | rigid | rigid | good | good | | | good | good | good |

From the results shown in Table 9, it becomes apparent that each of the golf balls using the resin compositions for intermediate layers of the present invention in Examples 1 to 10 has a good balance between the carrying distance, feeling of ball hitting, and durability. On the contrary, from the results shown in Table 10 and 11, it becomes apparent that each of the golf balls in Comparative Examples 1 to 11, and 14 to 16 is poor in either or all of the carrying distance, feeling of ball hitting, and durability, and that in each of Comparative Examples 12 and 13, the resin cannot be molded into a golf ball because of high viscosity of the resin composition for an intermediate layer.

While the preferred embodiments of the present invention have been described using the specific terms, such description is for illustrative purposes only, and it is to be understood that changes and variations may be made without departing from the spirit or scope of the following claims.

What is claimed:

1. A golf ball comprising a core, an intermediate layer, and a cover, said intermediate layer being formed by a resin composition, said resin composition comprising:

5 to 95 weight % of a polyester block copolymer (A) and 95 to 5 weight % of an ionomer resin (B); and a (polyester-aromatic vinyl based copolymer) block copolymer (C), which is mixed with both said polyester block copolymer (A) and said ionomer resin (B) in an amount of 1 to 40 parts by weight on the basis of 100 parts by weight of the total of said polyester block copolymer (A) and said ionomer resin (B);

wherein said polyester block copolymer (A) mainly contains a high-melting point crystalline polymer segment (a1) composed of a crystalline aromatic polyester unit, and a low-melting point polymer segment (a2) composed of an aliphatic polyether unit and/or an aliphatic polyester unit;

said ionomer resin (B) is obtained by neutralizing a copolymer mainly containing an α-olefine (b1) and an α,β-unsaturated carboxylic acid (b2) having 3 to 8 carbon atoms with at least one metal ion (b3) selected from univalent, divalent, and trivalent metal ions; and said (polyester-aromatic vinyl based copolymer) block copolymer (C) contains a block (c1) composed of a polyester, and at least one block (c2) selected from block or random copolymers containing aromatic vinyl based monomers and conjugated dienes and/or hydrogenated products thereof.

2. A golf ball according to claim 1, wherein said copolymer of said ionomer resin (B) is a copolymer mainly containing an α-olefine (b1) and an α,β-unsaturated carboxylic acid (b2) having 3 to 8 carbon atoms, and an acrylate and/or a methacrylate (b4).

3. A golf ball according to claim 1, wherein said polyester of said block (c1) is aromatic polyester.

4. A golf ball according to claim 1, wherein said polyester of said block (c1) is polybutylene terephthalate, and said block (c2) is a styrene-butadiene copolymer, styrene-isoprene copolymer or a hydrogenated product thereof.

5. A golf ball according to claim 1, wherein said high-melting point crystalline polymer segment (a1) mainly contains a polybutylene terephthalate unit.

6. A golf ball according to claim 1, wherein said low-melting point polymer segment (a2) mainly contains a poly(tetramethylene oxide)glycol unit.

7. A golf ball according to claim 1, wherein the copolymerized amount of said low-melting point polymer segment (a2) contained in said polyester block copolymer (A) is in a range of 15 to 90 weight %.

8. A golf ball according to claim 7, wherein the copolymerized amount of said low-melting point polymer segment (a2) contained in said polyester block copolymer (A) is in a range of 50 to 90 weight %.

9. A golf ball according to claim 1, wherein said ionomer resin (B) is composed of two or more ionomer resins obtained by neutralizing said copolymer with different kinds of metal ions.

10. A golf ball according to claim 1, wherein a stiffness modulus of said polyester block copolymer, measured in accordance with JIS K-7106, is in a range of 5 to 250 MPa, and a stiffness modulus of said ionomer resin (B), measured by JIS K-7106, is in a range of 25 to 500 MPa;

a difference in Shore D hardness measured in accordance with ASTM D-2240 between said polyester block copolymer (A) and said ionomer resin (B) [hardness of component (B)−hardness of component (A)] is in a range of 10 or more.

11. A golf ball according to claim 1, wherein a hardness, measured in accordance with ASTM D-2240, of said resin composition is in a range of 25 to 70.

12. A golf ball according to claim 1, wherein an impact resilience, measured in accordance with BS 903, of said resin composition is in a range of 40 to 90%.

13. A golf ball according to claim 1, wherein a hardness, measured in accordance with ASTM D-2240, of said resin composition is in a range of 25 to 70, and an impact resilience, measured in accordance with BS 903, of said resin composition is in a range of 40 to 90%.

* * * * *